US006939117B2

(12) United States Patent
Wheeler et al.

(10) Patent No.: US 6,939,117 B2
(45) Date of Patent: Sep. 6, 2005

(54) ROTARY APPARATUS

(75) Inventors: Daryl Wheeler, Gooseberry Hill (AU); Raalin Wheeler, South Perth (AU); Benjamin Dytynski, Bayswater (AU)

(73) Assignee: Merlin Corporation Pty Ltd (AU)

( * ) Notice: Subject to any disclaimer, the term of this patent is extended or adjusted under 35 U.S.C. 154(b) by 0 days.

(21) Appl. No.: 10/168,662

(22) PCT Filed: Dec. 20, 2000

(86) PCT No.: PCT/AU00/01571

§ 371 (c)(1),
(2), (4) Date: Jun. 21, 2002

(87) PCT Pub. No.: WO01/46561

PCT Pub. Date: Jun. 28, 2001

(65) Prior Publication Data

US 2002/0192100 A1 Dec. 19, 2002

(30) Foreign Application Priority Data

Dec. 21, 1999 (AU) ..... PQ 4791

(51) Int. Cl.[7] ..... F03C 2/00; F04C 18/00

(52) U.S. Cl. ..... 418/268; 418/185; 418/188; 418/266; 418/267

(58) Field of Search ..... 418/266–268, 418/185, 188

(56) References Cited

U.S. PATENT DOCUMENTS

| | | | | | |
|---|---|---|---|---|---|
| 1,336,997 | A | * | 4/1920 | Bolfing | 418/267 |
| 1,349,353 | A | * | 8/1920 | Wilber, Jr. | 418/185 |
| 4,047,857 | A | | 9/1977 | Fischer | |
| 4,106,472 | A | * | 8/1978 | Rusk | 418/266 |
| 4,390,328 | A | | 6/1983 | Fickelscher | |
| 4,451,215 | A | | 5/1984 | Winkler et al. | |
| 4,772,185 | A | | 9/1988 | Hertell | |
| 4,846,638 | A | | 7/1989 | Pahl et al. | |
| 5,733,113 | A | * | 3/1998 | Grupping | 418/188 |

FOREIGN PATENT DOCUMENTS

| | | | | |
|---|---|---|---|---|
| DE | 50086 | | 12/1889 | |
| DE | 51001 | | 2/1890 | |
| DE | 898 697 | | 12/1953 | |
| DE | 28 45 658 | | 4/1980 | |
| DE | 36 39 943 | | 6/1987 | |
| GB | 327153 | | 3/1930 | |
| GB | 569795 | | 6/1945 | |
| GB | 1383812 | | 2/1975 | |
| GB | 1545583 | | 5/1979 | |
| GB | 2192938 A | * | 1/1988 | F04C/18/40 |
| GB | 2292186 | | 2/1996 | |
| NL | 7712950 | | 5/1979 | |
| WO | WO 96/06265 | | 2/1996 | |

* cited by examiner

*Primary Examiner*—Theresa Trieu
(74) *Attorney, Agent, or Firm*—Allen, Dyer, Doppelt, Milbrath & Gilchrist, P.A.

(57) ABSTRACT

A rotary machine (10) comprises an inner housing (12) having valving means (14) which includes a shaft (15) for directing working fluid through the machine (10) and, an outer housing (16) within which the inner housing resides. A working chamber (18) is defined between the inner and outer housings (12 and 16). A plurality of gates (20) are supported by the inner housing and are swingable along their respective longitudinal axis between a sealing position in which the gates form a seal against surface (22) of outer housing (16) and a retracted position in which the gates (20) lie substantially against surface (24) of the housing (12).

33 Claims, 12 Drawing Sheets

ФИГ. 4.

ROTARY APPARATUS

FIELD OF THE INVENTION

The present invention relates to a rotary machine.

BACKGROUND OF THE INVENTION

Throughout this specification including the claims, the term "rotary machine" is intended to include both motors and pumps that act or operate on, or, are driven or otherwise operated by, a fluid.

Rotary machines have been known and used in various industries ever since the industrial revolution. In general terms, when operated as a motor, a high pressure fluid is fed through the machine and the pressure of the fluid used to impart motion to mechanical components to generate a mechanical kinetic energy used to power or drive some other machine. When operated as a pump, mechanical power is imparted to moving components of the pump which displace or force fluid through the machine to create a fluid flow and thus a pumping action.

The Applicant has been particularly innovative in the design and manufacture of rotary machines including, although not limited to, rotary machine for use as motors in oil and gas directional drilling. An example of such a rotary machine, configured as a motor is described in International Application No PCT/AU97/00682. A substantial benefit of the motor described in the aforementioned application is that, in comparison with other known motors, it has a substantially higher power density or power to weight ratio. This enables the motor to be of a significantly shorter length for the same power output as a conventional motor. This allows greater precision in directional control of a directional drill and the ability to turn at substantially smaller radii that can be achieved with the prior art.

Notwithstanding the substantial benefits of the motor described in the aforementioned application, the Applicant continues to conduct research and development in the area of rotary machine design. This research and development has led to the invention described herein.

SUMMARY OF THE INVENTION

According to the present invention there is provided a rotary machine including at least:

an inner housing;

an outer housing in which the inner housing resides, one of the inner and outer housings being rotatable relative to an other of the inner and outer housings, with a working chamber through which a working fluid flows being defined between the inner housing and the outer housing;

a plurality of gates supported by one of the inner housing and the outer housing (hereinafter "the supporting housing"), each gate swingable along its respective longitudinal axis between a sealing position in which the gates form a seal against a surface of the other one of the inner housing and outer housing ("the non-supporting housing") facing the working chamber and, a retracted position in which the gates are swung about their longitudinal axes to lie substantially against a surface of the supporting housing facing the working chamber; and, valve means operatively associated with said supporting housing for directing working fluid into said working chamber via said support housing.

Preferably the supporting housing is provided with a plurality of sockets extending longitudinally along its surface facing the working chamber and each gate is pivotally retained and supported in a respective socket to facilitate the swinging motion of the gates.

Preferably the sockets and the gates are complimentarily shaped so that when the gates are in the retracted position their radially outermost surface lies substantially flush with, or below, the surface of the supporting housing facing the working chamber.

Preferably each socket and each gate is provided with a first set of respective stop surfaces that come into mutual abutment when the gates swing to the sealing position from the retracted position.

Preferably each socket and gate is provided with a second set of respective stop surfaces spaced from the first set of stop surfaces have come into mutual abutment when the gates swing to the sealing position from the retracted position.

Preferably said first and second sets of respective stop surfaces are positioned so as to come into respective mutual contacts substantially simultaneously.

Preferably the supporting housing is provided with a plurality of inlet ports providing fluid communication between the valve means and the working chamber.

Preferably each inlet port has an opening into said working chamber and said gates are arranged to overlie said opening when in the retracted position wherein fluid passing through the inlet port urges said gate toward said sealing position.

Preferably the non-supporting housing is provided with a plurality of lobes each of which forms a seal against the surface of the supporting housing facing the working chamber to divide the working chamber into a plurality of sub-chambers, said lobes configured to force said gates toward said retracted position upon engagement of the lobes with the gates.

Preferably said non-supporting housing is provided with at least one exhaust port for each sub-chamber for exhausting fluid entering a sub-chamber.

In one embodiment when the supporting housing is the inner housing the valve means is in the form of a shaft extending coaxially into and rotatable relative to the supporting housing, the shaft having an axial passage in fluid communication with a supply of said working fluid and a plurality of radially extending holes providing fluid communication between said axial passage and the inlet ports in the supporting housing for a predetermined period of time per revolution of the shaft relative to the supporting housing.

Preferably said valve means is provided with adjustment means to facilitate adjustment of the flow of said fluid into said inlet ports.

Preferably said adjustment means includes a sleeve located coaxially with the shaft and moveable relative to the shaft, said sleeve provided with one or more apertures extending radially therethrough, and means for effecting movement of said sleeve relative to said shaft to allow variation in overlap or alignment of the apertures and the holes to thereby control the flow of said working fluid from said supply to the inlet ports.

Preferably said means for effecting movement includes coupling acting between the outer housing, a connector used for connecting the rotary machine to a supporting apparatus and, one of the shaft and the sleeve; whereby a torque differential between the outer housing and the supporting apparatus is transmitted by said coupling to act between said sleeve and said shaft to effect said movement of the sleeve relative to the shaft.

In an alternate embodiment, when the supporting housing is the outer housing, said valving means comprises a plate disposed coaxially of the outer housing, the plate provided with a feed channel on a side distant the supporting housing in fluid communication with a supply of working fluid and a plurality of slots cut in the axial direction through the plate for providing fluid communication between said feed channel and the inlet ports in the supporting housing for a predetermined period of time per revolution of the plate relative to the supporting housing.

In this alternative embodiment the inlet ports extend axially though the outer housing and open at an end of the housing adjacent the plate.

BRIEF DESCRIPTION THE DRAWINGS

Embodiments of the present invention will now be described by way of example by way of example only with reference to the accompanying drawings in which.

DETAILED DESCRIPTION OF THE PREFERRED EMBODIMENTS

Figure 1:
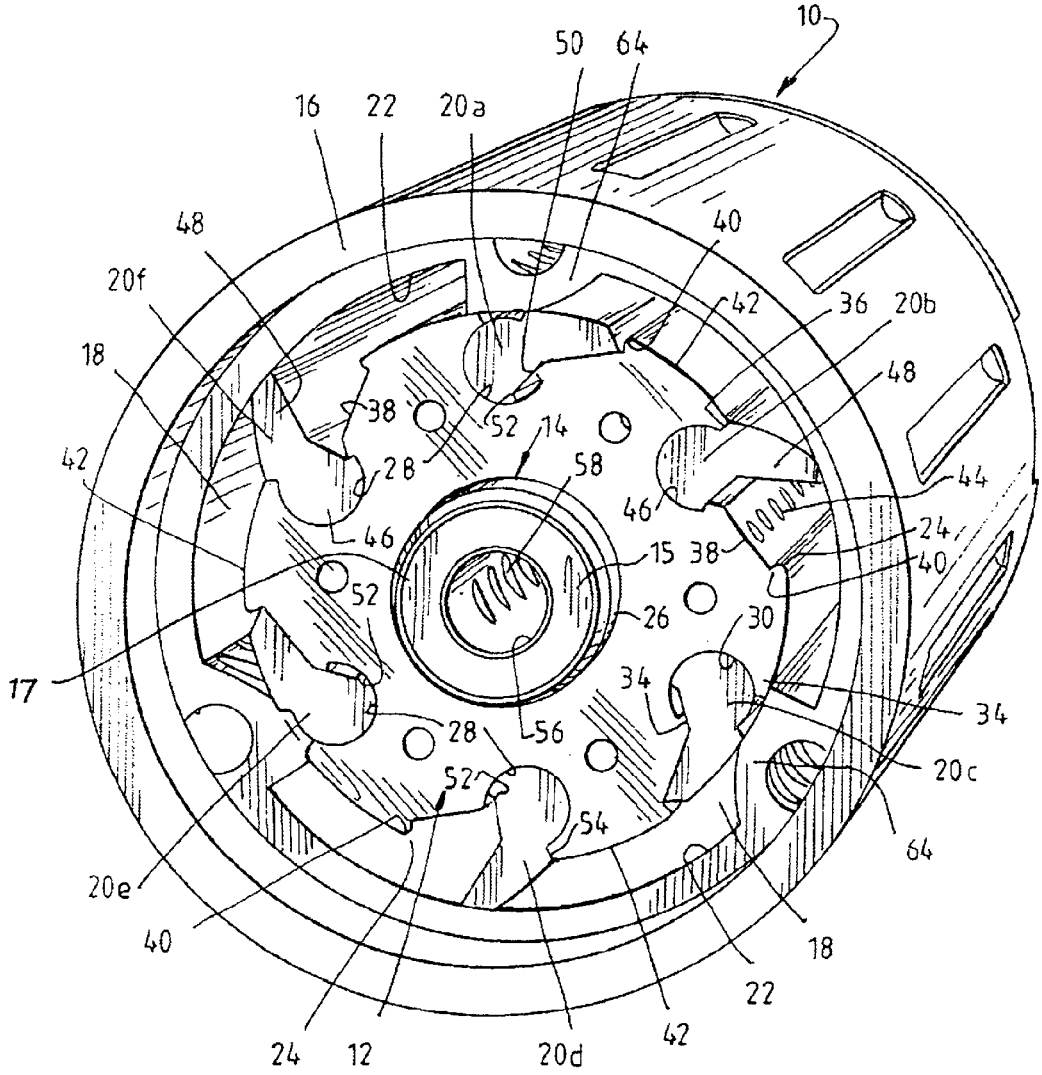
FIG. 1 is a schematic representation of a partial assembly of a rotary machine in accordance with one embodiment of this invention.

Referring to the accompanying drawings and in particular FIGS. 1–5, it can be seen that the rotary machine 10 comprises an inner housing 12 provided with a valve 14 comprising a member 17 in the form of a shaft 15 that directs working fluid through the machine 10 and, an outer housing 16 in which the inner housing 12 resides. The inner and outer housings 12 and 16 are formed coaxially of each other with one of the housings being rotatable relative to the other about a common axis. A working chamber 18 through which the working fluid flows is defined between the inner housing 12 and the outer housing 16. A plurality of gates 20*a*–20*f* (referred to in general as "gates 20") are supported in this embodiment, by the inner housing 12. For convenience, the inner housing 12 is therefore referred to as the "supporting housing 12". Each gate 20 is swingable along its respective longitudinal axis between a sealing position in which the gates form a seal against surface 22 of the outer housing 16 that faces the working chamber 18 and, a retracted position in which the gates 20 are swung about their respective longitudinal axes to lie substantially against the peripheral surface 24 of the supporting housing 12 that faces the working chamber 18.

Throughout this specification and claims the term "seal" when used in relation to describing the formation of a seal when a gate 20 is in the sealing position, is intended to include the formation of a substantial seal in which a small or controlled degree of leakage can occur. As described in greater detail hereinafter, the gates 20 when in the sealing position are spaced by a controlled distance from portions the surface 22 of the non-supporting housing 16 other than the lobes. The amount of clearance provided is dependent on the nature of the fluid passing through the rotary machine 10. Generally the greater the viscosity or density of the fluid, the greater the clearance.

In the embodiment depicted in FIGS. 1–5 the supporting housing 12 (ie the inner housing 12) rotates (ie acts as a rotor) while the non-supporting housing 16 is rotationally fixed (ie acts as a stator). Further, the shaft 15 is fixed relative to the non-supporting housing 16.

The supporting housing 12 can be considered to be a cylindrical length of material provided with an axial bore 26 and a plurality of sockets 28 extending longitudinally along its outer peripheral surface 24. The sockets 28 are evenly spaced about the circumference of the supporting housing 12. The sockets 28 have, in general, a shape that is complimentary to the shape of the gates 20 so that when the gates are in the retracted position (depicted by gates 20*a*, 20*c* and 20*e* in FIG. 5) the radially outermost surface of each gate 20 is flush with or set back from the surface 24 of the supporting housing 12.

Each socket 28 has a first portion 30 of arcuate shape when viewed in plan and a contiguous second portion 32. The first portion 30 is bound on opposite sides by a step 34 that leads to the second portion 32 and a ridge 36 that leads to the arcuate, radially outermost portion 42 of peripheral surface 24. The step 34 leads to a planar inclined seat 38. A radially distant edge of the seat 38 terminates in a step 40 leading to the arcuate radially outermost portion 42.

The supporting housing 12 is also provided with a plurality of radially extending inlet ports 44 that provide fluid communication between the shaft 12 and the working chamber 18. The inlet ports 44 open: at their radially outermost end onto seats 38 on the supporting housing 12 and, at their radially innermost end onto the circumferential surface of the bore 26. The inlet ports 44 are arranged in rows that extend longitudinally along the seats 38.

The gates 20 have, in transverse section, a shape somewhat like a comma having an arcuate root 46 and a depending leg 48. The root 46 is shaped so that it can be slid into the first portion 30 of the socket 28 and to allow the gate 20 to swing along its longitudinal axis within the socket 28. Indeed the coupling of the gates 20 with the sockets 28 is somewhat akin to the human hip joint. The gates 20 are formed as longitudinal elements of the same length as the sockets 28. A flat 50 is formed along one side of the root 46 contiguously with the leg 48 so as to create a step 52 in the root 46. A further step 54 is formed on the opposite side of the root 46 as a location where it adjoins the leg 48 (see for example gates 20*b* in FIGS. 1 and 5). The step 52 in gate 20 and the step 34 in the socket 28 form respective first stop srrfaces that come into mutual abutment when the gate 20 is swung to the sealing position (as shown by gates 20*b*, 20*d* and 20*f* in FIG. 5). This assists in providing a predetermined clearance between the radially outermost end of gate 20 and the surface 22 of the non-supporting housing 16 (other than the lobes 64). Accordingly there is no surface to surface contact between gates 20 and the surface 22 (except on lobes 64) thus substantially eliminating wear in this part of the machine 10. This clearance does allow for some leakage of the fluid but the clearance is arranged so that the leakage is controlled.

Further, the step 54 on gate 20 and step 36 on socket 28 form a second set of respective stop surfaces that some into mutual abutment when the gate 20 is swung into the sealing position. This further assists in maintaining the predetermined clearance. The degree of clearance for any particular application will depend on, among other things, the viscosity or density of the working fluid. The clearance can be varied by appropriate positioning of the steps 34, 52 and 54 and the ridge 36. The abutment or engagement of steps 34 and 52; and ridge 36 and step 54, also provides support to the gates 20 when under load.

Figure 4:
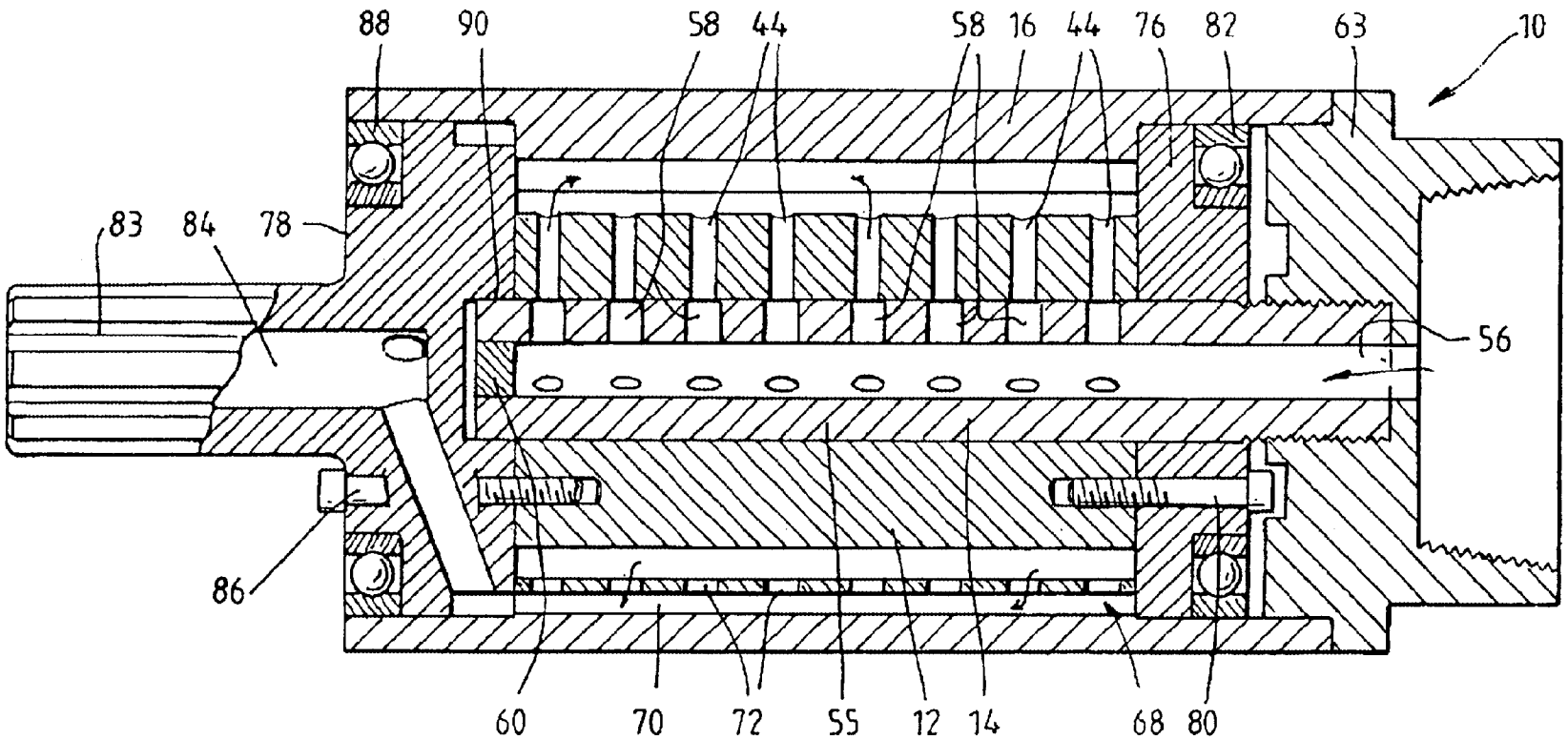
FIG. 4 is a longitudinal section view of a rotary machine incorporating the components shown in FIGS. 1–3.
Figure 5:
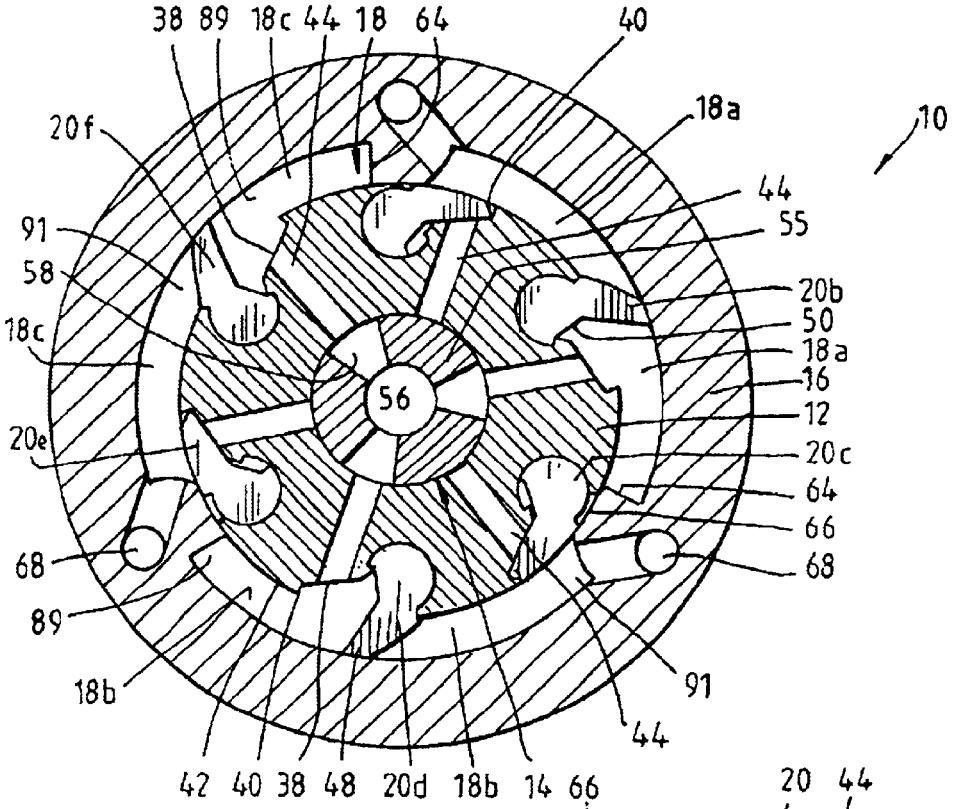
FIG. 5 is a cross-sectional view of the rotary machine shown in FIG. 4.

Referring to FIGS. 1, 4 and 5 the shaft 15 has an axial passage 56 in fluid communication with a supply of the working fluid, and a plurality of radially extending holes 58 that provide a fluid communication between the passage 56 and the inlet ports 44 in the supporting housing 12. An upstream end of the shaft 15 is sealed with a plug 60. The supporting housing 12 rotates relative to the shaft 15. Accordingly the holes 58 are sequentially brought into and out of alignment or registration with the inlet ports 44. The amount of fluid that can pass from the shaft 15 to the working chamber 18 is dependent upon the area of the opening of the holes 58 on the outer circumferential surface of the shaft 55. The greater the arc length of holes 58 the greater is the time of registration between the holes 58 and the inlet ports 44. This provides a mechanism for timing fluid pulsed into the working chamber 18. It also brings about or facilitates the valving aspect of the shaft 15 as in effect the shaft 15 opens and closes a fluid communication path between the inlet ports 44 and the supply of the working fluid.

The non-supporting housing 16 is in the general form of an open-ended cylindrical drum. Extending axially from an upstream end of the non-supporting housing 16 is a plurality of spaced apart lugs 62 (refer FIG. 3). These lugs are configured to engage corresponding recesses in a string connector 63 (shown in FIG. 4) used to connect the motor 10 to a drill string. The engagement of the lugs in the recesses enables torque to be coupled from the drill string to the supporting housing 16. A plurality of lobes 64 (in this case three) are provided longitudinally along the surface 22 of the non-supporting housing 16. The lobes have a radially innermost surface 66 that is concavely curved to match the curvature of the arcuate portion 42 of the peripheral surface 24 of the supporting housing 12, as well as the curvature of the radially outer surface of the legs 48 of gates 20 when the gates 20 are in the sealing position. The lobes 64 together with the supporting housing 12 divide the working chamber 18 into three sub-chambers 18*a*, 18*b* and 18*c* being respective sectors of the working chamber 18 located between mutually adjacent lobes 64. As explained in greater detail below, the sub-chambers 18*a*, 18*b* and 18*c* are further divided by gates 20 when in the sealing position.

An exhaust port 68 is formed in each of the lobes 64. The exhaust ports 68 comprise an axially extending bore 70 formed through each lobe 64 and a plurality of feed holes 72 that pass transversely through the lobes 64 to provide fluid communication between the working chamber 18 and the bore 70. The feed holes 72 are arranged in a longitudinal row along a surface 74 of each lobe 64 that joins the surface 66 to the surface 22.

Referring to FIG. 4, it can also be seen that the machine 10 is provided with end plates 76 and 78 at opposite axial ends. The end plate 76 is essentially in the form of a disc having a central hole through which the shaft 15 extends. The end plate 76 is fixed to the supporting housing 12 by one or more bolts 80. A bearing 82 is seated in a shoulder formed on the end plate 76 to allow for relative rotation between the supporting housing 12 and the non-supporting housing 16.

The upstream end of the machine 10 is closed with the end plate 78. The end plate 78 is provided with an axially extending drive shaft 83. The drive shaft 83 is provided with an internal passage 84 which is in fluid communication with the exhaust ports 68 formed in the non-supporting housing 16. End plate 78 is also coupled by means of bolts 86 to the supporting housing 12. A bearing 88 sits in a shoulder formed in the end plate 78 to facilitate relative rotation of the supporting housing 12 to the non-supporting housing 16. The surface of the end plate 78 internal of the motor 10 is provided with a central recess 90 for seating the upstream end of the shaft 15. The shaft 15 is coupled to the non-supporting housing 16 via the string connector 63.

As depicted most clearly in FIG. 5, when the gates 20 are in the retracted position (for example gates 20*a*, 20*c* and 20*e*) their respective legs 48 overlie the inlet ports 44. The gates 20 are effectively held in the retracted position by abutment with the lobes 64. However, once out of abutment, the gates 20 are urged or indeed forced to the move to the sealing position by the pressure of the working fluid when the holes 58 are in partial or full registration with the inlet ports 44. As seen in FIG. 5, the valve 14 (ie shaft 15) can be arranged so in effect the inlet ports 44 are timed to be out of alignment with the holes 58 when the gates 20 are in abutment with the lobes 64 but, are in partial or full registration when the gates 20 are out of abutment with the lobes 64.

It is further apparent that when the gates 20 are in the sealing position they divide the sub-chambers 18*a*, 18*b* and 18*c* into two separate chambers namely an induction chamber 89 and an exhaust chamber 91, the respective volumes of which change dynamically as the supporting housing 12 rotates (see FIG. 5).

The operation of the motor 10 will now be briefly described.

Working fluid (for example compressed nitrogen or other gas, or a liquid or slurry such as water or drilling mud) is channelled into the shaft 15 of valve means 14 by a drill string or other equipment attached to the upstream end of the machine 10. When the holes 58 are in registration with the inlet ports 44, the fluid is able to pass into the inlet ports 44. When the gates 20 are not in abutment with the lobes 64, the pressure of the fluid pushes the gates 20 to the sealing position and the fluid fills an induction chamber 89 portion of the respective sub-chamber 18*a*–18*c* formed between a particular gate 20 and the lobe 64 it most recently passed. An exhaust chamber 91 portion of the sub-chamber is in fluid communication with the exhaust port 68. Accordingly ordinarily there will be a pressure differential in any particular sub-chamber between opposite sides of a gate 20. As such, the working fluid is able to expand (if it is a gas) or otherwise act to force the gates 20 and thus the rotor 12 to rotate in the anti-clockwise direction. As the supporting housing 12 rotates in this direction eventually a gate 20 in the sealing position comes into abutment with the next lobe 64. However prior to this abutment, fluid supply is cut off to the inlet port 44 adjacent that gate by virtue of the supporting housing 12 rotating relative to shaft 15 so that the inlet port is not in registration with any hole 58. As such, the gate 20 commences to move toward the retracted position breaking the seal against the surface 22. The fluid previously in the induction chamber 89 is able to bypass the gate 20 and flow into the adjacent exhaust chamber 91 to be swept out the machine via the exhaust port 68. By this time, the inlet port 44 of the preceding gate 20 will have come into registration with holes 58 in the shaft 15 and, assuming that particular gate is out of abutment with the lobe 64, the pressure of the fluid will urge the gate 20 to the sealing position and enter the next induction chamber 89. The fluid then again expands or acts to push the gate 20 and thus the rotor 12 in the anti-clockwise direction. In this way, the fluid drives the motor 10 to cause rotation of the supporting rotor 12 and the end plate 78 and drive shaft 83. The gas exhausted through the exhaust port 68 passes through the passage 84 and exits the machine 10 altogether. When used in directional drilling a drill bit (not shown) will be coupled to the drive shaft 83.

The cyclic alignment or registration of the holes 58 in shaft 15 and the inlet ports 44 in the supporting housing 12 forms a valve for pulsing fluid into the working chamber 18. The timing of the pulses of fluid can be changed by varying the shape and configuration of the holes 58 in the shaft 15 and/or the shape and configuration of the radially innermost end of the inlet ports 44.

Figure 6:
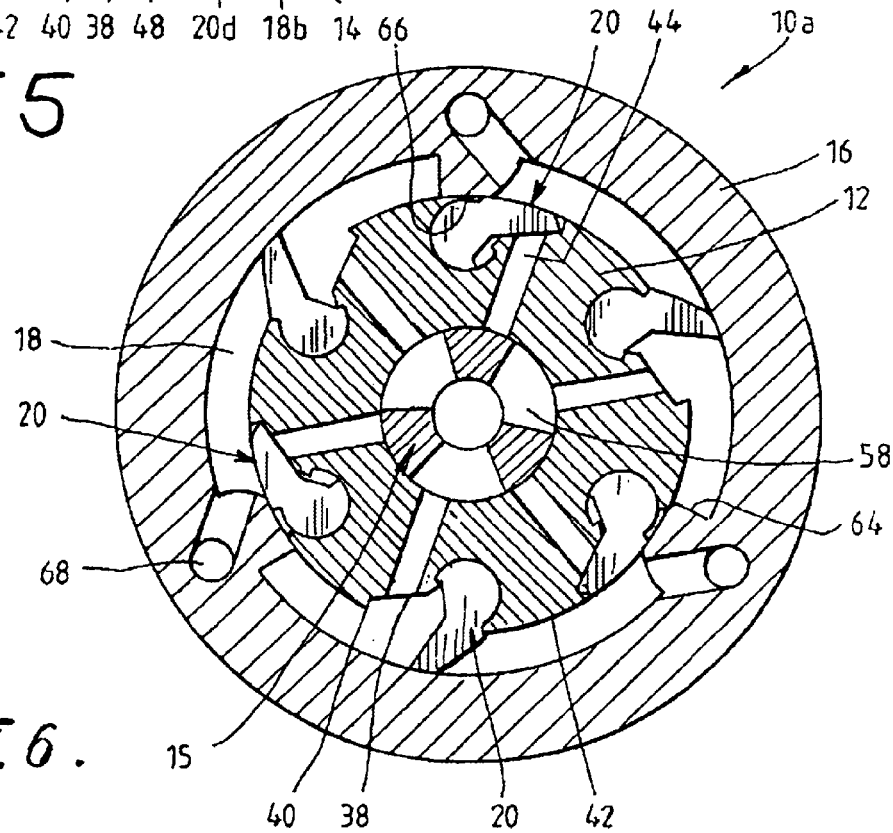
FIG. 6 is a cross-sectional view of a second embodiment of the rotary machine.

FIG. 6 illustrates a further embodiment of the machine 10*a*. The machine 10*a* differs from the embodiment of the machine 10 depicted in FIGS. 1–5 (and in particular in FIG. 5) only by the configuration of the holes 58 in the shaft 15. In the machine 10*a* the holes 58 have a longer arc length at their radially outermost end. Consequently, the holes 58 are in partial or full registration with the input ports 44 for a greater period of time per revolution of the supporting housing 12, in comparison with the embodiment depicted in FIG. 5. In all other respects the machine 10*a* is structurally and functionally the same as the machine 10. It will be appreciated that by appropriately configuring the holes 58 it is possible for the same hole 58 to be in fluid communication with two adjacent inlet ports 44 simultaneously.

Figure 7:
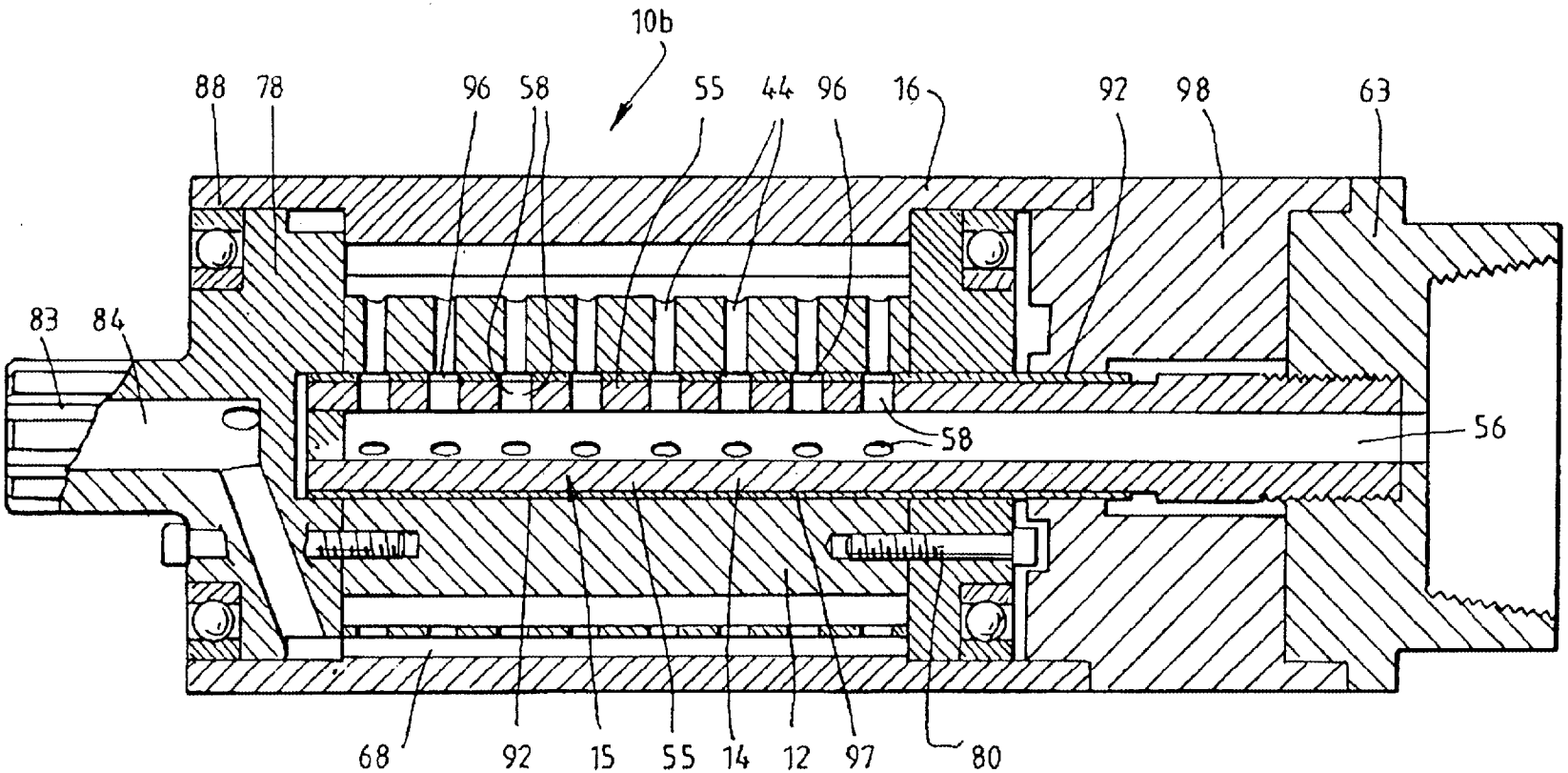
FIG. 7 is a longitudinal section view of third embodiment of the rotary machine.
Figure 8:
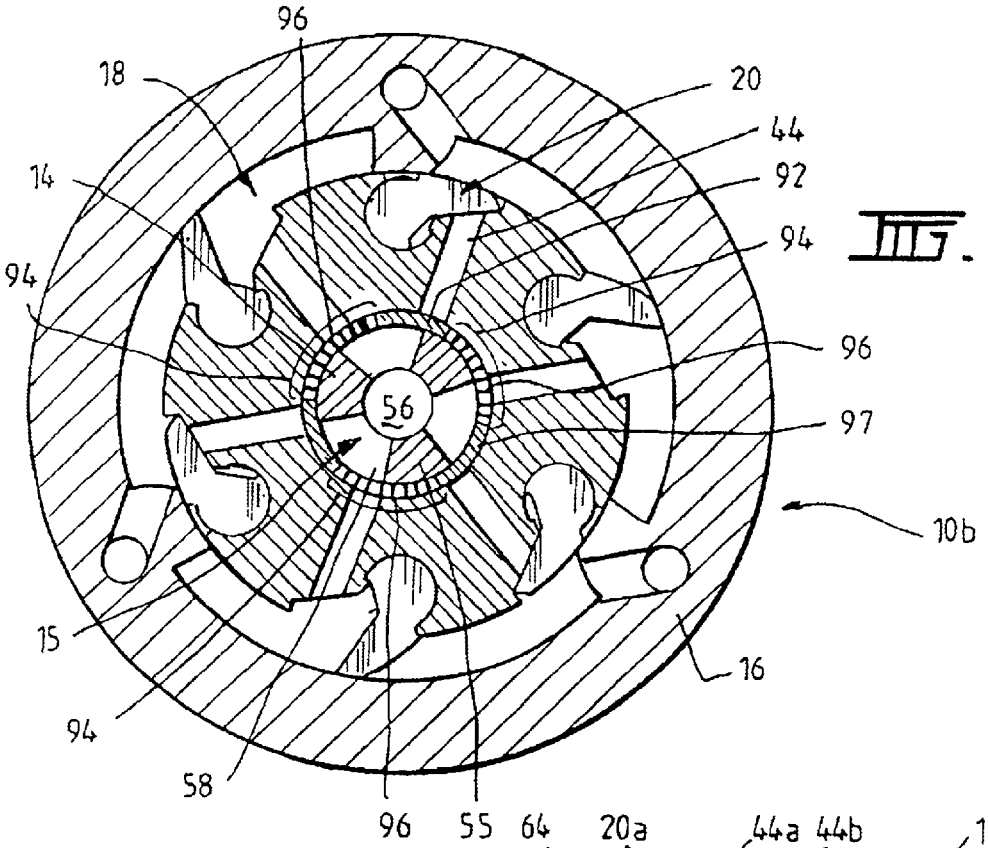
FIG. 8 is a cross-sectional view of the rotary machine shown in FIG. 7.

FIGS. 7 and 8 illustrate a further embodiment of the machine 10*b*. The embodiment 10*b* differs from that of machine 10 depicted in FIGS. 1–5 by the provision of adjusting means to further control or vary the timing and duration of the fluid pulses into the working chamber 18. The adjusting means in essence comprises a sleeve 92 that fits over the shaft 15. The combination of the sleeve 92 and the shaft 15 forms the valve means 14 in this embodiment. When reviewed in transverse section as depicted in FIG. 8, the sleeve 92 comprises a plurality of spaced apart bands 94 of apertures 96. The bands 94 are separated by bands of solid material 97 having no perforations or apertures. The bands 94 extend in a circumferential direction to an extent so as to be able to wholly overlie the holes 58 in the shaft 55. When this occurs the maximum volume of fluid is able to flow through the valve means 14 into the inlet port 44. By varying the rotational position of the sleeve 92 relative to the shaft 15, the degree of overlap between the band of apertures 94 with the holes 58 can be varied thereby changing the pulsing characteristics of the fluid into the inlet port 44.

In order to provide for the rotation of the sleeve 92 relative to the shaft 15 a coupling 98 is provided between the non-supporting housing 16, string connector 63 and the sleeve 92. Typically the coupling 98 could be made from a resilient material. The shaft 15 is fixed to the string connector 63. The coupling 98 is sensitive to torque differentials between the housing 16 and the connector 63. Thus, if there is a difference in torque applied to the housing 16 and the string connector 63 they will be able to rotate relative to each other to a degree dependent upon the resilience of the coupling 98. It will be appreciated because the shaft 15 is fixed to the string connector 63 any relative rotation between the housing 16 and the string connector 63 will be transmitted via the coupling 98 to the sleeve 92 so as to rotate the sleeve 92 relative to the shaft 15. This will effect the relative alignment between the bands of apertures 94 with the openings 58 in shaft 15. Therefore the duration and timing of fluid pulses into the inlet ports 44 and subsequently the working chamber 18 can be automatically adjusted in accordance with a torque differential between the housing 16 and the string connector 63. This may be particularly useful to avoid an over speed condition in the machine 10 that may otherwise arise if the motor 10 is lifted from the ground during drilling prior to shutting off the supply of fluid used to drive the machine 10.

Yet another embodiment of the machine 10*c* is depicted in FIGS. 9A–9D. The machine 10*c* differs from the embodiment 10 depicted in FIG. 5 in terms of the exhaust porting.

In the machine 10*c*, the fluid is exhausted via a exhaust porting system that is formed in the supporting housing 12 rather than in the non-supporting housing 16 as depicted in FIG. 5. The exhaust system in the machine 10*c* includes a separate axial exhaust gallery 99 formed in the supporting body 12 for each of the gates 20. The exhaust galleries 99 are disposed radially inward of the gates 20. Extending transversely from each exhaust gallery 99 is a row of spaced apart exhaust channels 100. The channels 100 open onto the socket 28 of the nearest gate 20. Each gate 20 is also provided with an exhaust gallery 102 extending axially through the root portion 46. Extending transversely to the gallery 102 is a series of spaced apart first exhaust ports 104. The ports 104 open at one end onto the gallery 102 and at a distant end open onto the surface of the respective gates 20. A second set of exhaust ports 106 is formed along the length of each gate 20. The ports 106 extend transversely to the exhaust gallery 102 and are angularly spaced from the ports 104. The ports 106 open at one end onto the exhaust gallery 102 and open at the opposite end onto the surface of the root 46 of each gate 20. Finally, the exhausting system includes a series of exhaust entry ports 108 formed in the supporting housing 12. The exhaust entry ports 108 extend between the arcuate portion 42 of the outer surface of supporting housing 12 to an adjacent socket 28.

In this embodiment, the gate 20 effectively acts as a valve to open and close the exhaust system. As shown with particular reference to gate 20*a* in FIG. 9C when gate 20*a* is in the sealing position the exhaust ports 104 and 106 are moved into registration with the exhaust entry ports 108 and the exhaust channel 100 respectively so that fluid can be exhausted via the ports 108, 104, gallery 102, port 106, channel 100 and gallery 98. However when the gates 20 are in the retracted position, for example as depicted by gate 20*f* in FIG. 9D, the exhaust entry port 108 is effectively sealed by the root 46 of gate 20*f* thereby shutting the exhaust port. This ensures that fluid entering the inlet chamber 89 is not able to be exhausted via the exhausting system incorporated in the gate 20*f*.

Figure 10:
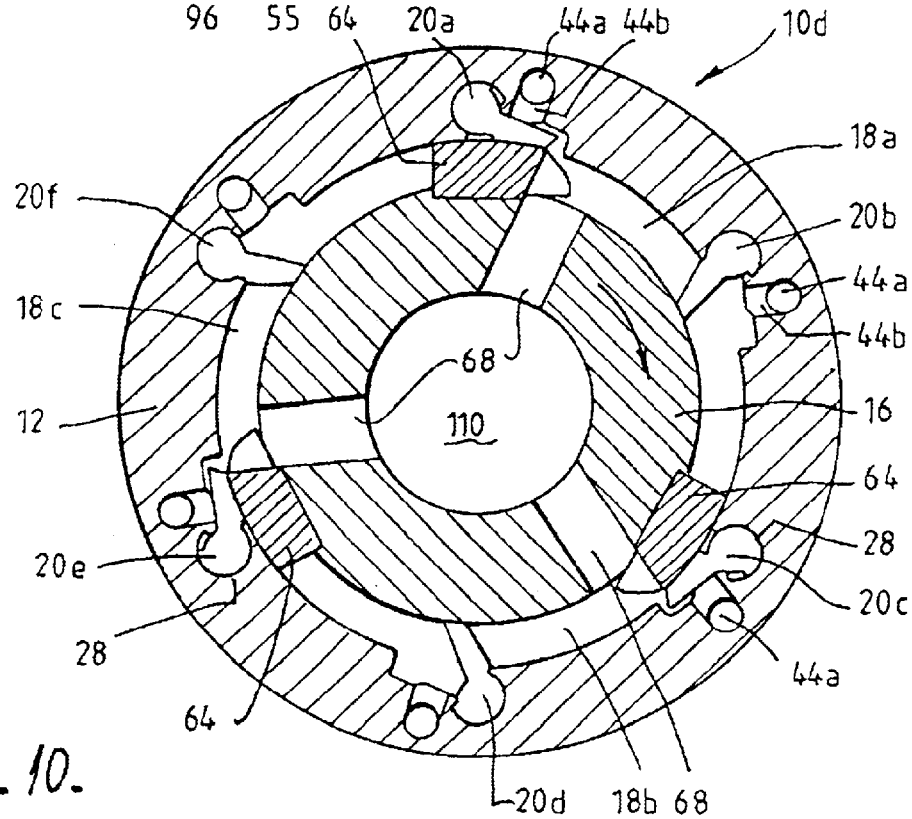
FIG. 10 is a cross-sectional view of a fifth embodiment of the rotary machine.
Figure 9A:
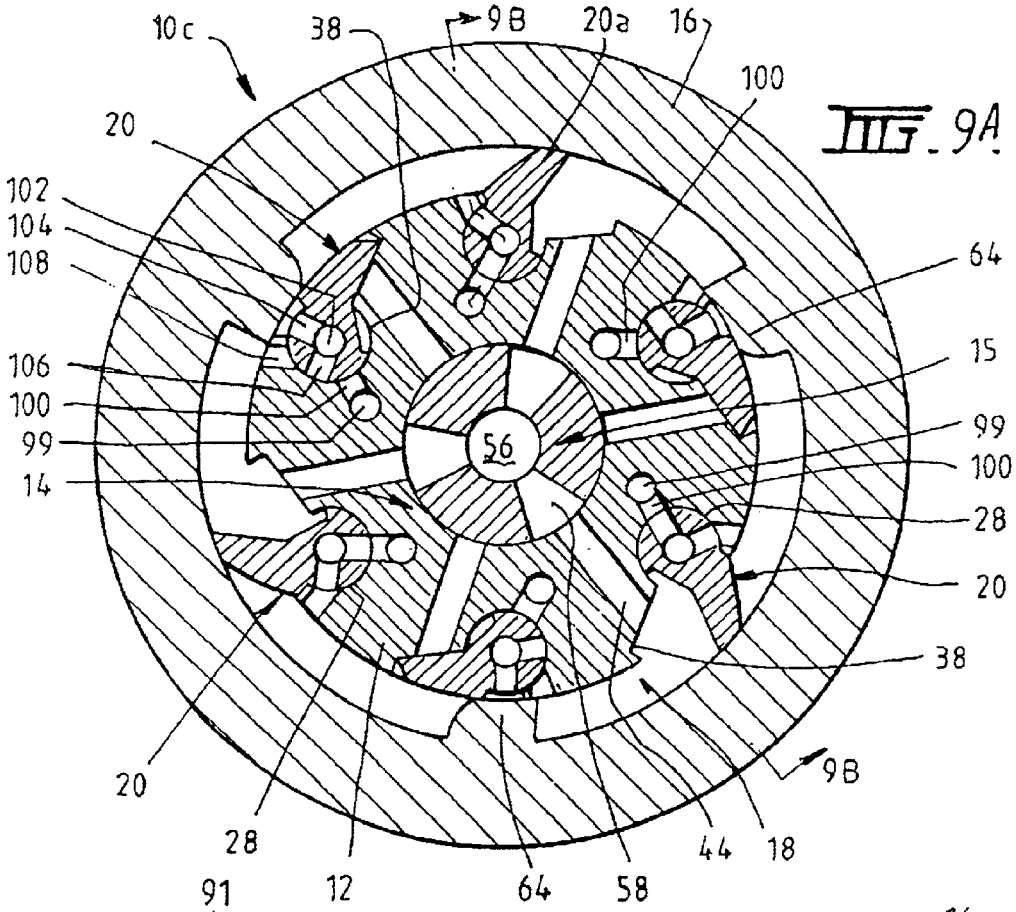
FIG. 9A is a cross-sectional view of a fourth embodiment of the rotary machine.
Figure 9C:
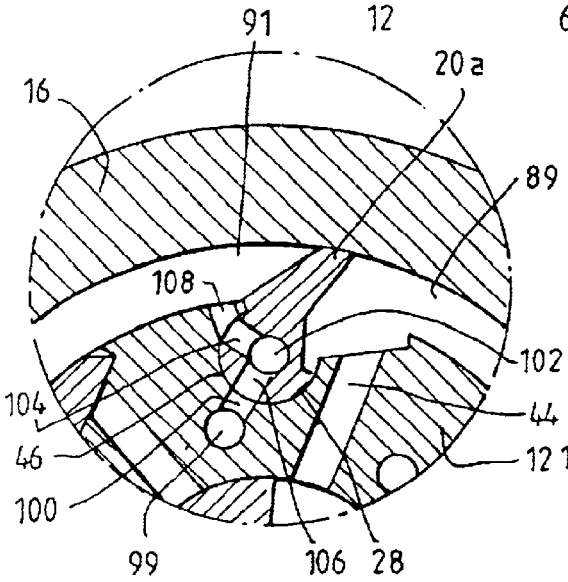
FIG. 9C is an enlarged view of a portion of the machine depicted in FIG. 9A with its exhaust system open.
Figure 9D:
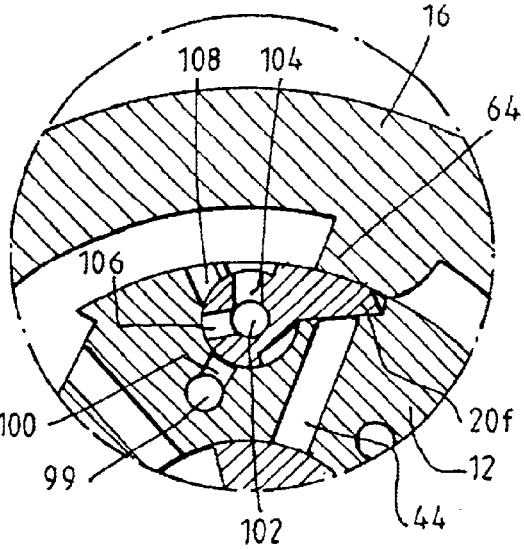
FIG. 9D is an enlarged view of a portion of the machine shown in FIG. 9B but with the exhausting system shut.
Figure 9B:
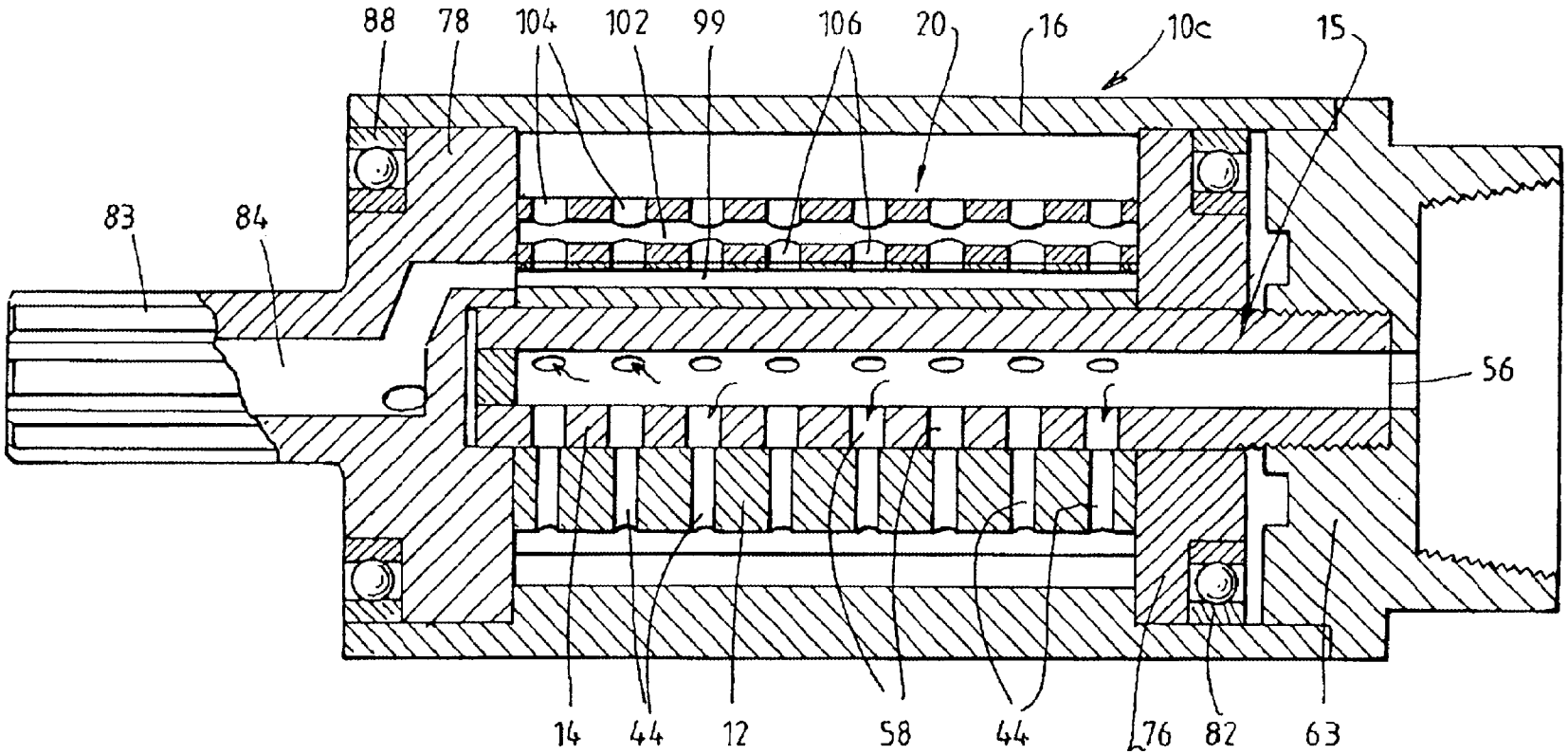
FIG. 9B is a longitudinal section view of the rotary machine shown in FIG. 9A.
Figure 11:
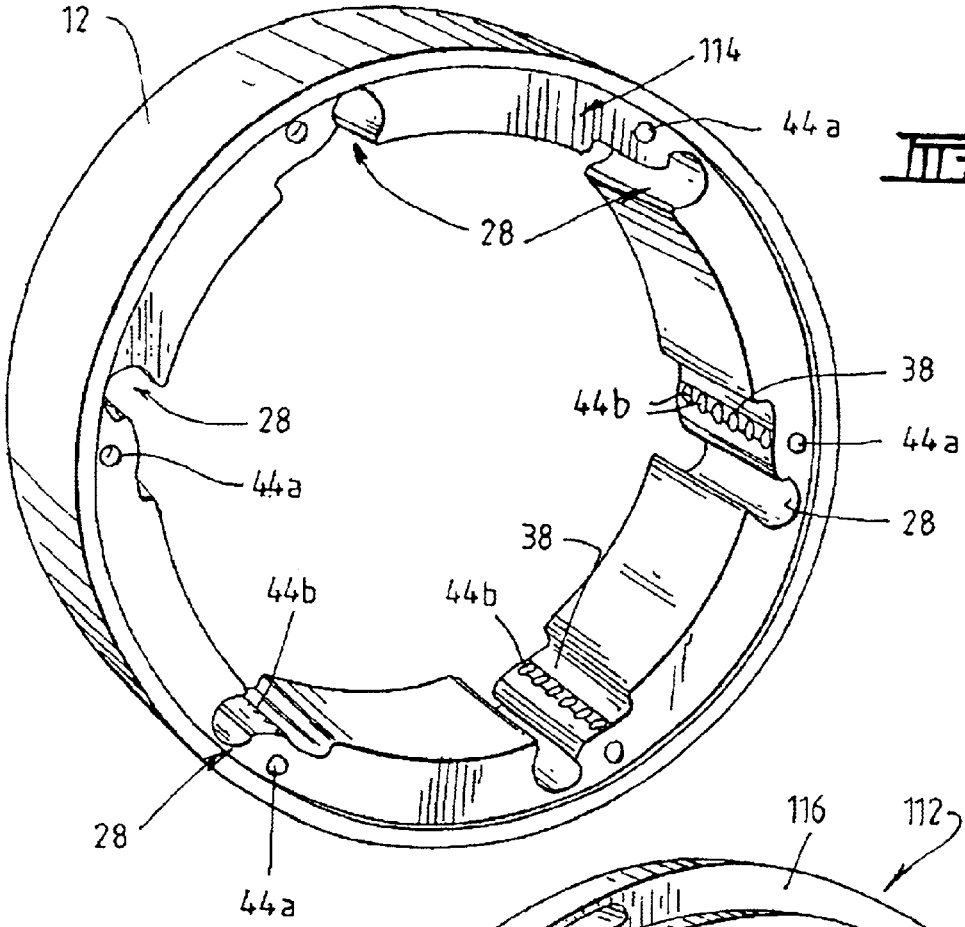
FIG. 11 is a perspective view of the outer housing of the fifth embodiment of the rotary machine shown in FIG. 10.

FIG. 10 depicts yet another embodiment of the machine 10*d*. In general terms the embodiment of the machine 10*d* is the inverse of the embodiment 10 depicted in FIG. 5. In this regard, the supporting housing 12 is now the outer housing where the non-supporting housing 16 is the inner housing. As with the previous embodiments, the gates 20 are pivotally retained within sockets 28 formed in the supporting housing 12. Lobes 64 are supported on the non-supporting housing 16 for moving the gates 20 to the retracted position and also for subdividing the working chamber 18 into sub-chamber 18*a*, 18*b* and 18*c*. The fluid is exhausted via exhaust ports 68 formed radially in the non-supporting housing 16 and lead to a central axial exhaust gallery 110. A further difference to the machine 10*b* to the previous embodiments is that the supporting housing 12 in machine 10*d* is stationary and the non-supporting housing 16 rotates. The inlet ports in this embodiment comprise a combination of axially extending holes 44*a* and transverse holes 44*b*. The axial holes 44*a* are equally spaced about the circumference of the housing 12 and are each located adjacent a corresponding socket 28. Each hole 44*a* is provided with a plurality of transverse extending smaller holes 44*b*. The holes 44*b* provide fluid communication between the holes 44*a* and the respective seats 38 of each socket 28.

Figure 12:
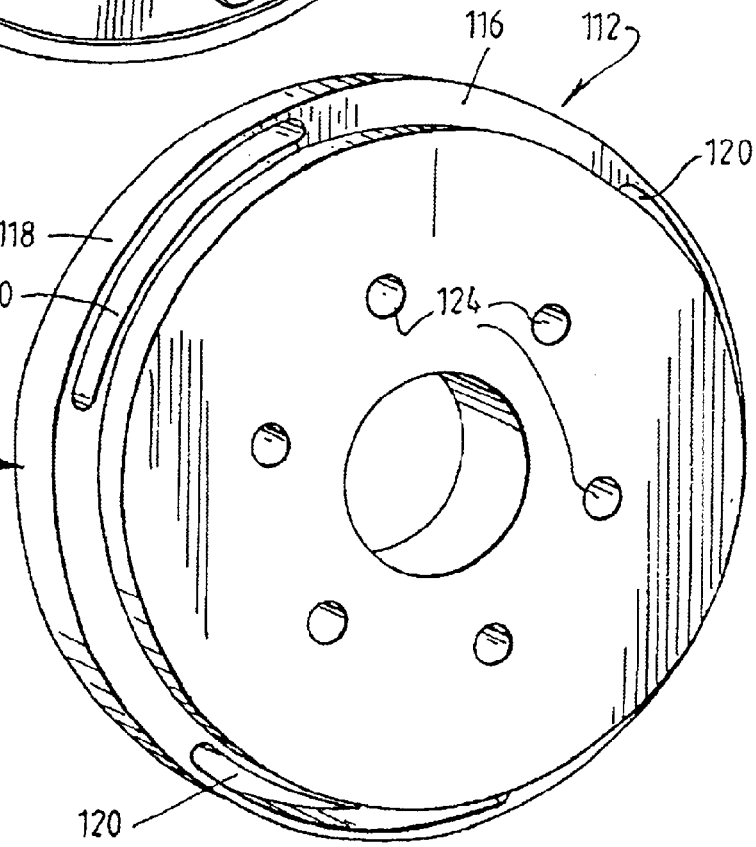
FIG. 12 is a perspective view of a valving plate for directing working fluid into the working chamber of the fifth embodiment of the rotary machine depicted in FIG. 10.

In this embodiment, the member 17 of the valve 14 is in the form of a plate 112 (see FIGS. 12 and 13) rather than the shaft 15 of the earlier embodiments. The plate 112 is disposed coaxially at an upstream end 114 of the housing 12. The plate is provided with an annular feed channel 116 on a side distant the end 114. The feed channel 116 provides fluid communication with a supply of working fluid. Channel 116 can be formed by machining a recess about the circumference of the plate 112. The unmachined portion of the plate 112 is left as a circumferential flange 118 in which is formed three arcuate slots 120. The slots 120 provide fluid communication between the channel 116 and the holes 44*a* constituting part of the inlet ports of the rotary machine 10*d*. The angular length of the slots 120 determines the duration of pressurization of a particular inlet hole 44*a*. Whilst the slot 120 overlies a particular hole 44*a*, working fluid is able to pass into the machine 10*d* via the registered slot 120 and hole 44*a*. It will be appreciated that the arc length of the slots 120 can be made to provide a predetermined valve timing for pulsing fluid into the machine 10*d*. For example the slots 120 can be of length to ensure that at any one time a slot is able to register with only one inlet hole 44*a*. On the other hand, one or more of the slots 120 can be made of a greater arcuate length so that at a predetermined time the slot 120 can be in registration with two adjacent inlet port holes 44*a*.

The plate 112 is also provided with a plurality of bolt holes 124 for bolting to the inner non supporting housing 16.

Figure 13:
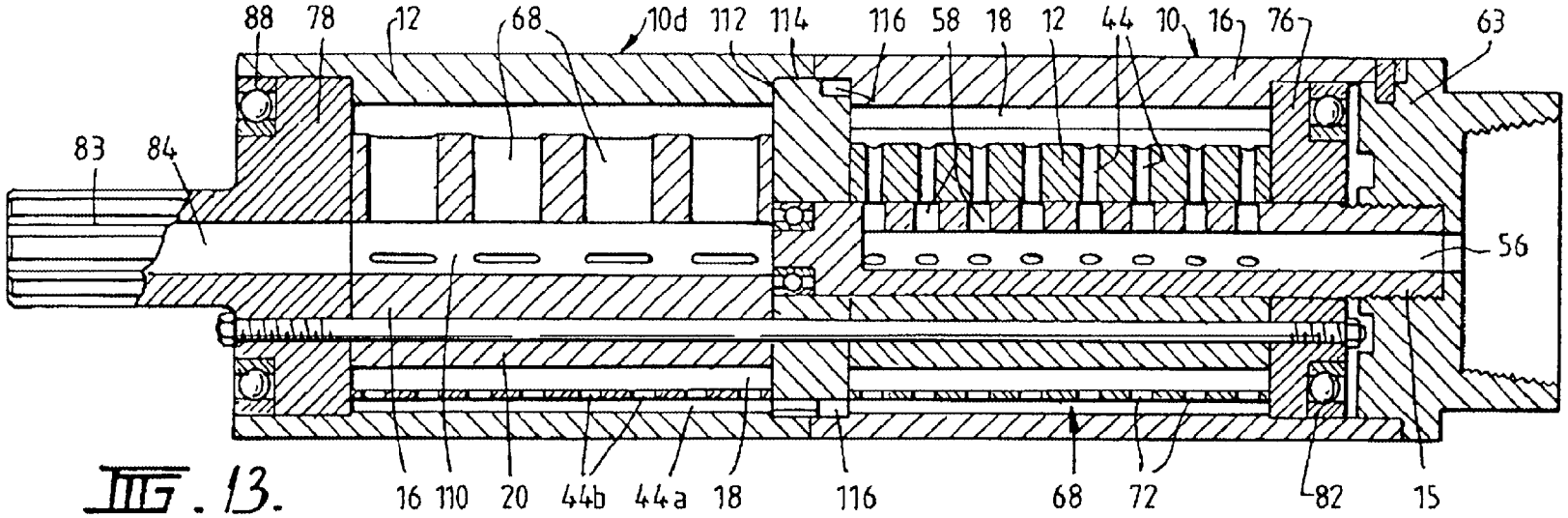
FIG. 13 is a longitudinal section view of a compound rotary machine composed of the first and fifth embodiments of the rotary machine coupled in series.

FIG. 13 depicts a compound rotary machine 10*e* comprised of machine 10 and machine 10*d* coupled in series. Machine 10 is at the upstream end and machine 10*d* at the downstream end. Fluid is channelled via shaft 15 into the machine 10 passing through the holes 58 into inlet channels 44 and subsequently into the working chamber 18 of machine 10. Thereafter, the fluid is exhausted via feed holes 72 and bore 70 of the exhaust port 68 in machine 10. The exhausted fluid then forms the feed fluid or the supply fluid for the downstream machine 10*d*. Here the fluid enters the feed channel 116 in the plate 112 and passes to the slots 120. When the slots 120 are in registration with the inlet holes 44*a* in the supporting housing 12 of machine 10*d* the fluid is able to pass into the working chamber 18. From there the fluid is exhausted through the exhaust port 68 of the machine 10*d* passed through the channel 84 and out the end of the drive shaft 83. In this embodiment that the plate 112 rotates with the supporting housing 12 of the machine 10 and the non supporting housing 16 of machine 10*d*.

The series connection of the machines 10 and 10*d* can improve the energy efficiency as the exhaust fluid from machine 10 that would otherwise be lost or wasted is now used to drive machine 10*d*.

Figure 14:
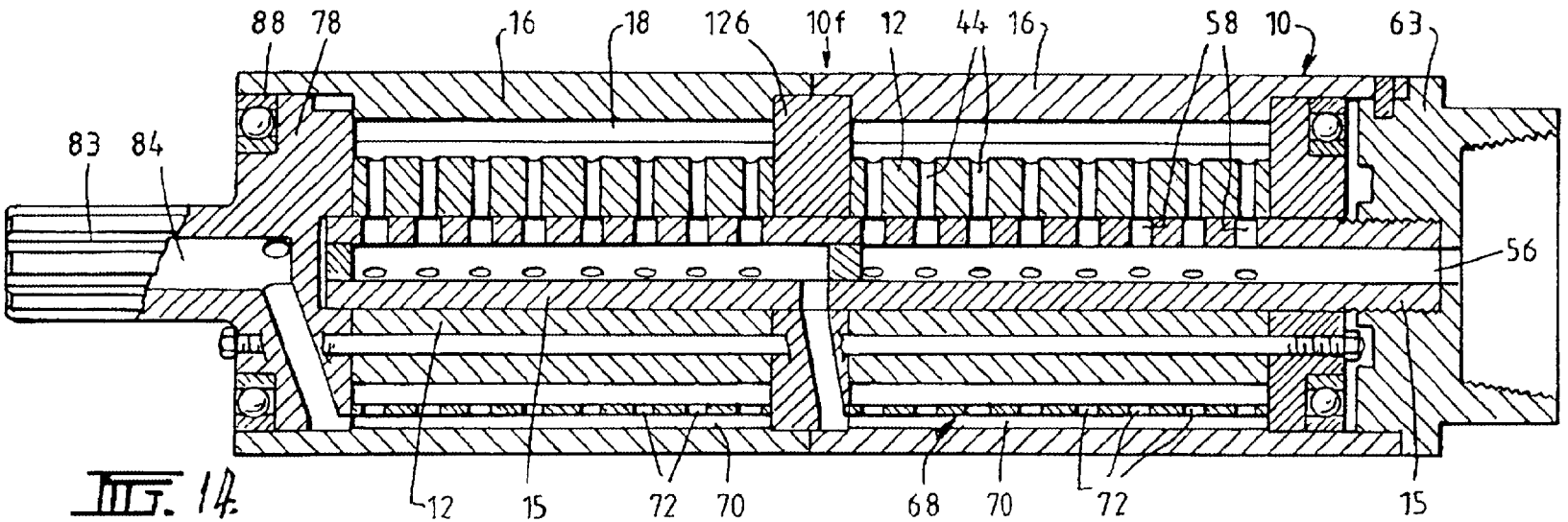
FIG. 14 is a longitudinal section view of a further compound rotary machine composed of two rotary machines in accordance with the first embodiments coupled in series.

FIG. 14 depicts a further embodiment of a compound machine 10*f* this time comprising two machines 10 coupled in series. The machines 10 are essentially in the same form as described in relation to FIGS. 1–5. A coupling plate 126 provided between the machines 10 in order to direct the exhaust fluid from the exhaust port 68 of the upstream motor 10 to the shaft 15 of the downstream machine 10. The plate 126 is fixed to the supporting housing 12 and rotates therewith. In this way, the fluid communication between the exhaust of the upstream machine 10 to the inlet of the downstream machine 10 is maintained at all times. Otherwise, the operation of the compound machine 10*f* is in substance the same as that described in relation to machine 10.

Figure 15:
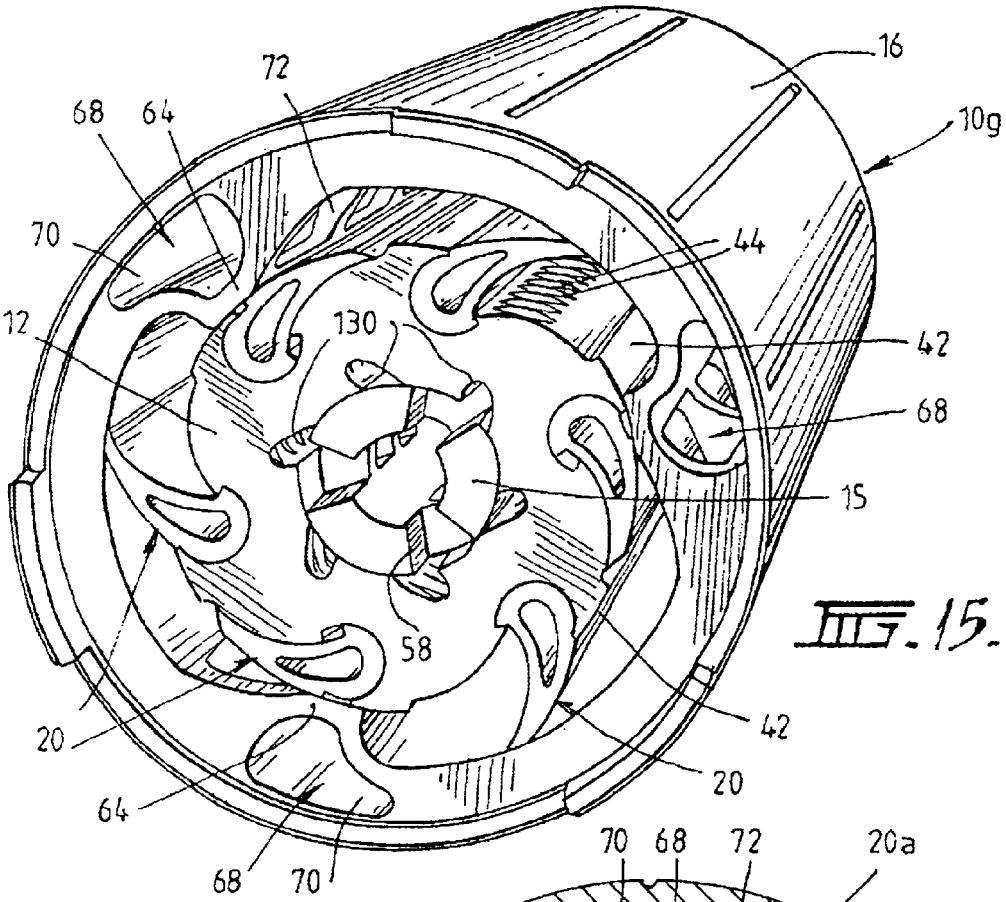
FIG. 15 is a perspective view of a further embodiment of the rotary machine.
Figure 16:
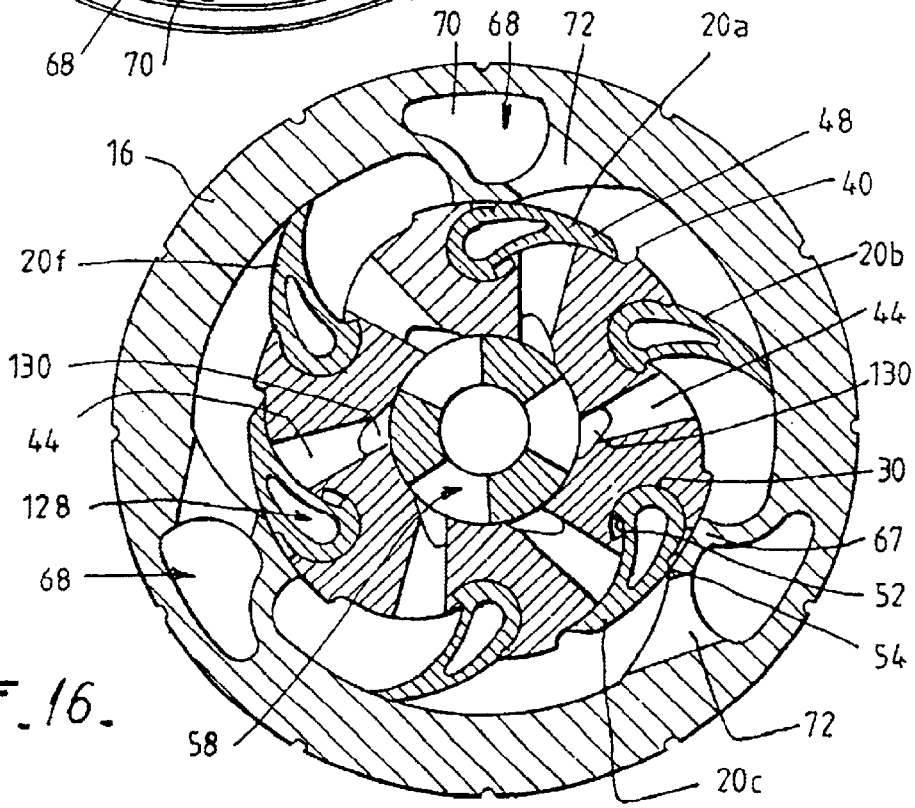
FIG. 16 is a cross-sectional view of the machine shown in FIG. 15.
Figure 17:
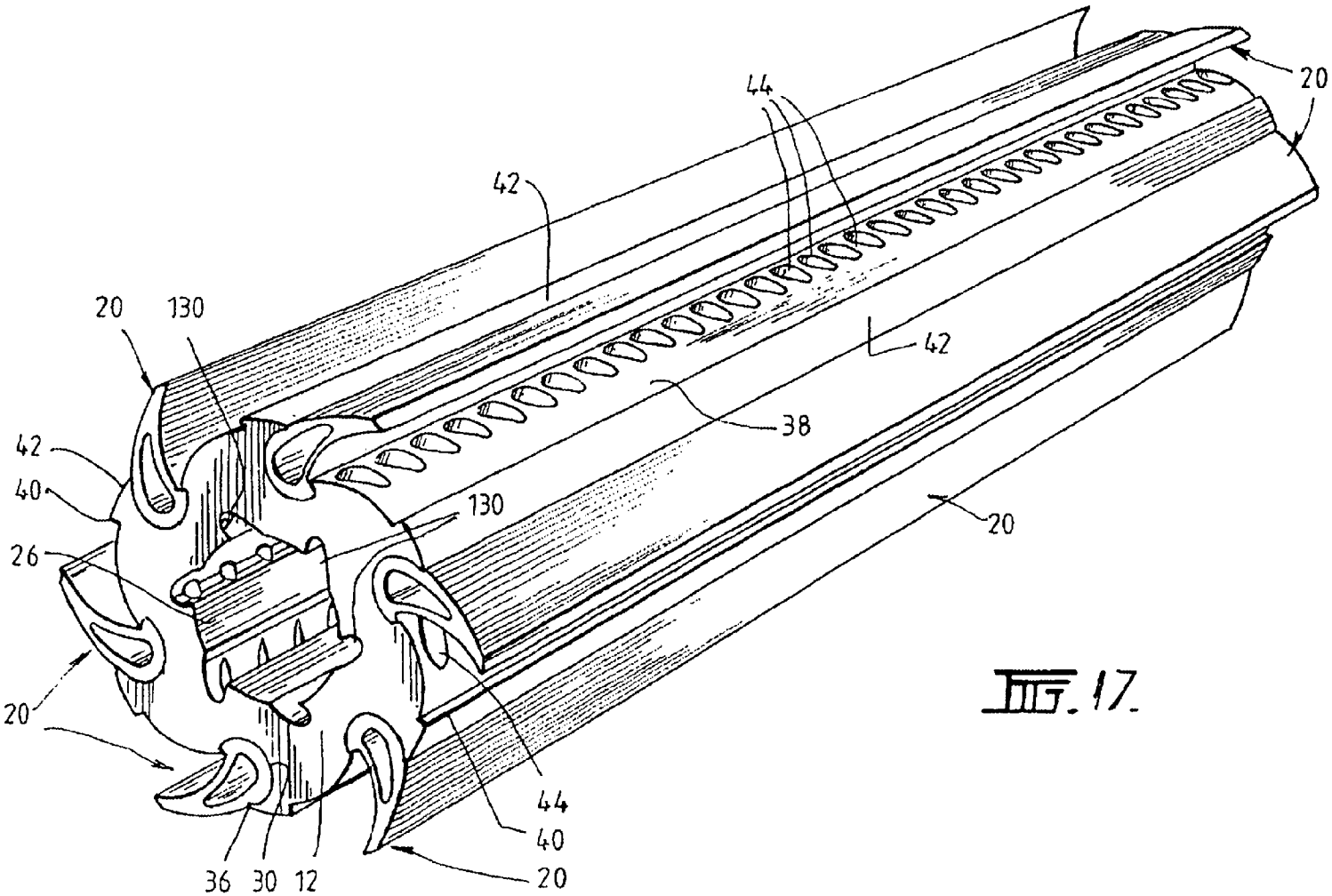
FIG. 17 is a perspective view of a supporting housing with coupled gates incorporated in the machine depicted in FIGS. 15 and 16.

A further embodiment of the rotary machine 10*g* is illustrated in FIGS. 15–17. In terms of general layout and operation the machine 10*g* is in substance the same as machine 10. However in the machine 10*g* the shape and configuration of various components have been modified.

Looking firstly at the non-supporting housing 16, the exhaust ports 68 have a much larger cross-sectional area than the corresponding exhaust ports in machine 10. Here, the axially extending bore 70 of the exhaust ports 68 is of an irregular shape rather than circular section as in machine 10 and additionally has a larger cross-sectional area extending radially into the body of the non-supporting housing 16. The feed holes 72 are also wider than their counterparts in machine 10. Further, a backside 65 of the lobe 64 that extends between the surfaces 66 and 22 is curved rather than square as in machine 10.

The gates 20 in machine 10*g* have a "swept back" or more aerodynamic shape than those of machine 10. This comes about by concavely curving the side of the leg 20 that contacts the peripheral surface 24 of the supporting housing 12 when a gate is in the retracted position. In comparison with machine 10, the corresponding side of the gate 20 is in the form of two planar surfaces that intersect at an obtuse included angle. Also, the gates 20 in machine 10*g* are hollow, being provided with an axial bore 128 having a cross-sectional shape somewhat similar to that of a teardrop.

Figure 2:
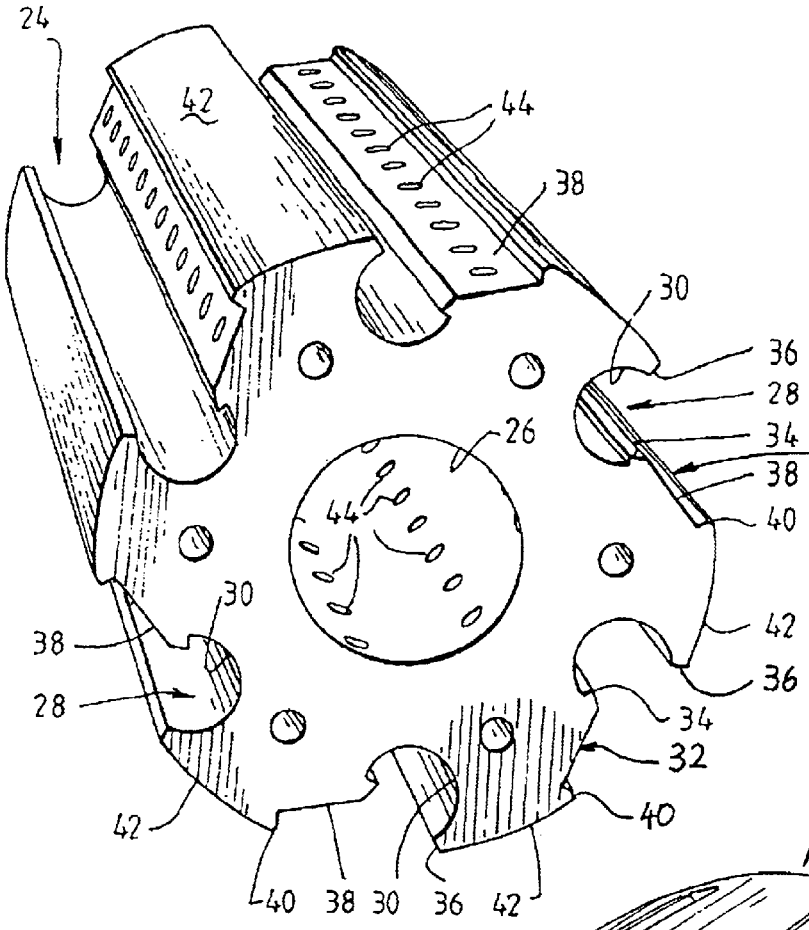
FIG. 2 is a perspective view of an inner housing incorporated in the rotary machine shown in FIG. 1.
Figure 3:
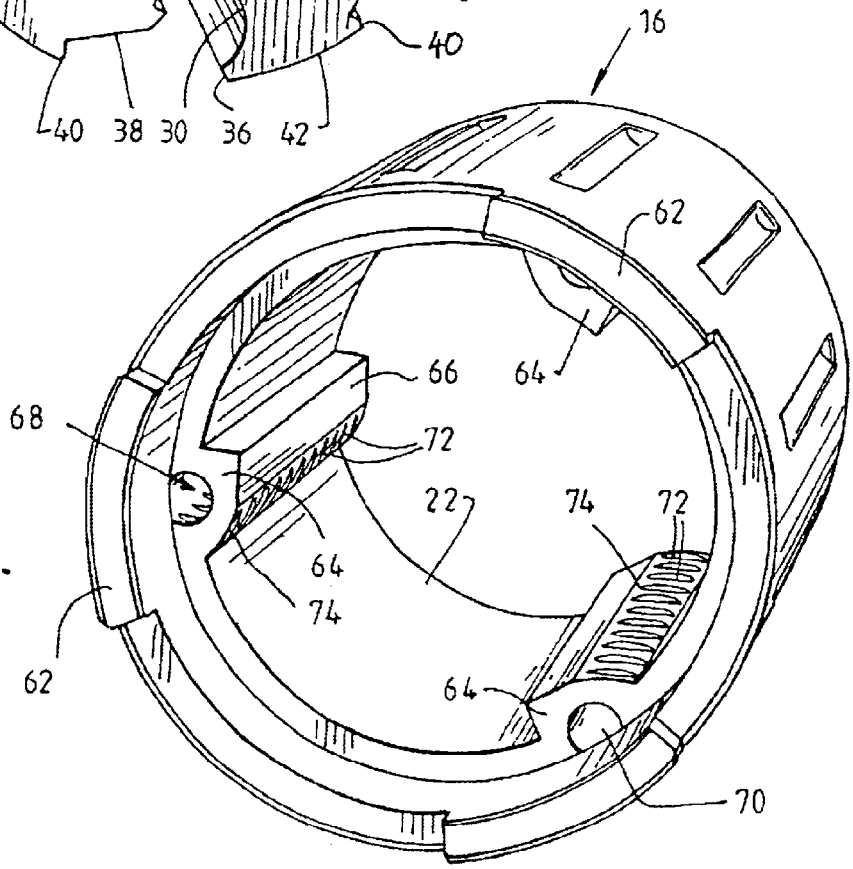
FIG. 3 is a perspective view of an outer housing incorporated in the rotary machine shown in FIG. 1.

The supporting housing 12 of machine 10*g* has a same general form as that in machine 10 but is of a different configuration. Starting from the outer peripheral surface 24, the seats 38 are arcuate rather than planar as in machine 10 and also the transversal arc length of the seats 38 is greater than those for machine 10. Additionally, the arcuate portion 42 of the outer peripheral surface is of a shorter arc length than in machine 10. The sockets 28 in machine 10*g* are each provided with an arcuate portion 30 bound on one side by ridge 36 and on the opposite side by a step 34 (see the socket in which gate 20*b* in FIG. 16 resides). Step 34 leads to the seat 38 into which inlet port 44 opens. The ridge 36 leads to the arcuate surface 42. Further, as shown in FIG. 16 the inlet ports 44 are of progressively increasing diameter in the radially outward direction. In comparison, in machine 10 as depicted in FIGS. 2 and 5, the inlet ports 44 are of uniform diameter. However, it is to be understood that in a alternate embodiment which is not shown, the ports 44 and machine 10*g* can also be either of uniform or constant diameter or indeed have a diameter that tapers in the opposite direction to that depicted. A further difference in the supporting housings 12 is that in machine 10*g* a central bore 26 is provided with six spaced apart and separate channels 130. Each channel 130 provides fluid communication for each respective axial banks of inlet ports 44. This assists in equalising fluid pressure especially while the gate 20 is in or near the retracted position.

The machine 10*g* functions in the same manner as machine 10 although, theoretically at least, with greater efficiency. In particular, the shape of the gates 20 in machine 10*g* creates better dynamic flow characteristics for the fluid entering the working chamber 18. When the gate 20 is being returned to the retracted position the shape of the gate allows for a cleaner flow of fluid away from the seat 38 prior to the gate being seated. Further, due to the shape of the gate it is possible for the fluid pressure to give the gate some radial deflection at its tip while in the sealing position. This can assist with sealing or wear compensation.

Further, by making the gates 20 hollow, they can be made lighter and therefore reduce the inertia to the mechanical components that are rotating, pivoting or oscillating thus providing improved efficiency and extending machine life by reducing wear. It is further envisaged that the bore 128 in the gates 20 could be supplied with pressurised fluid and vented around the sockets 28 to give fluid lubrication to the sockets. Alternately, the bore 128 could be filled with a resilient-type material with cavities projecting into the supporting housing 12 to secure the gates in place to allow their movement in a manner akin to an artificial ligament.

The increased size of the exhaust ports 68 in machine 10*g* allows for more efficient exhausting of spent fluid. Also, the tapering of the inlet ports 44 with the larger end opening onto the seat 38 allows for fluid to start expansion (when it is a gas) in the port prior to entering the working chamber. The shape of the port 44 also results in the fluid being able to act on a greater area of the gate 20 for the purpose of pushing or forcing the gate 20 more effectively into the sealing or extended position.

Now that embodiments of the machine 10 have been described in detail it will be apparent to those skilled in the relevant art that numerous modifications and variations may be made without departing from the basic inventive concepts. For example, the machine 10 can be made with any number of gates 20 and any number of sub-chambers. Also, many different arrangements can be made for valving the inlet manifold 14. In the embodiments depicted in FIGS. 7 and 8 the valving is effected by placing a sleeve 92 together with a plurality of apertures 94 over the shaft 15 and providing a means for rotating the sleeve 92 relative to the shaft. However different arrangements can be made. For example, rather than a relative rotational motion, a relative sliding motion can be effected by use of other control means. The control means may be a mechanical linkage or means for causing sliding motion of the sleeve relative to the shaft 15 by virtue of fluid pressure. Further, instead of the valve operating on the basis of a torque differential it may operate on the basis of rotational speed of the inner housing so as to progressively restrict the flow of fluid into the machine 10 as speed increases.

All such modifications and variations together with others that would be obvious to a person of ordinary skill in the art are deemed to be within the scope of the present invention the nature of which is to be determined from the above description.

What is claimed is:

1. A rotary machine including at least:

an inner housing;

an outer housing in which the inner housing resides, one of the inner and outer housings being rotatable relative to another of the inner and outer housings, with a working chamber through which a working fluid flows being defined between the inner housing and the outer housing;

a plurality of gates supported by one of the inner housing and the outer housing, wherein the housing supporting the gates constitutes a supporting housing and the housing not supporting the gates constitutes a non-supporting housing, each gates swingable along its respective longitudinal axis between a sealing position in which the gates form a seal against a surface of non-supporting housing and a retracted position in which the gates lie substantially against a surface of the supporting housing facing the working chamber, said supporting housing provided with a plurality of inlet ports through which the working fluid flows into the working chamber;

a plurality of lobes supported by the non-supporting housing and which form a seal against a facing surface of the supporting housing thereby dividing the working chamber into a plurality of sub-chambers, each lobe defining an exhaust port for exhausting the working fluid from an adjacent sub-chamber wherein each of the exhaust ports comprising an axially extending bore formed through each of the lobes and a plurality of feed holes that passes through each of the lobes for communicating the working fluid between the working chamber and the bore; and a valve operatively associated with said supporting housing that directs said working fluid into the working chamber via the support housing, the valve comprising a shaft extending coaxially into and rotatable relative to the supporting housing, the shaft having an axial passage in fluid communication with a supply of said working fluid and a plurality of radially extending holes providing fluid communication between said axial passage and the inlet ports in the supporting housing for a predetermined period of time per revolution of the shaft relative to the supporting housing.

2. The rotary machine according to claim 1, wherein the supporting housing is further provided with a plurality of sockets extending longitudinally along its surface facing the working chamber and each gate is pivotally retained and supported in a respective socket to facilitate the swinging motion of the gates.

3. The rotary machine according to claim 2, wherein the sockets and the gates are complementarily shaped so that when the gates are in the retracted position their radially outermost surface lies substantially flush with, or below, the surface of the supporting housing facing the working chamber.

4. The rotary machine according to claim 3, wherein each socket and each gate is provided with a first set of respective stop surfaces that come into mutual abutment when the gates swing to the sealing position from the retracted position.

5. The rotary machine according to claim 4, wherein each socket and gate is provided with a second set of respective stop surfaces spaced from the first set of stop surfaces have come into mutual abutment when the gates swing to the sealing position from the retracted position.

6. The rotary machine according to claim 5, wherein said first and second sets of respective stop surfaces are positioned so as to come into respective mutual contacts substantially simultaneously.

7. The rotary machine according to claim 6, wherein said lobes form a seal against the surface of the supporting housing facing the working chamber to divide the working chamber into a plurality of sub-chambers, and wherein said lobes force said gates toward said retracted position upon engagement with said gates.

8. The machine according to claim 6, wherein the supporting housing is provided with a plurality of inlet ports providing fluid communication between the valve and the working chamber.

9. The machine according to claim 8, wherein each inlet port has an opening into said working chamber and said gates are arranged to overlie said opening when in the retracted position wherein fluid passing through the inlet port urges said gate toward said sealing position.

10. A rotary machine comprising:

an inner housing;

an outer housing in which the inner housing resides, one of the inner and outer housings being rotatable relative to another of the inner and outer housings, with a working chamber through which a working fluid flows being defined between the inner housing and the outer housing;

a plurality of gates supported by one of the inner housing and the outer housing, wherein the housing supporting the gates constitutes a supporting housing and the housing not supporting the gates constitutes a non-supporting housing, each gate swingable along its respective longitudinal axis between a sealing position in which the gates form a seal against a surface of the non-supporting housing, and a retracted position in which the gates lie substantially against a surface of the supporting housing facing the working chamber;

a plurality of lobes supported by the non-supporting housing and which form a seal against a facing surface of the supporting housing thereby dividing the working chamber into a plurality of sub-chambers, each lobe defining an exhaust port for exhausting the working fluid from an adjacent sub-chamber wherein each of the exhaust ports comprising an axially extending bore formed through each of the lobes and a plurality of feed holes that passes through each of the lobes for communicating the working fluid between the working chamber and the bore; and valve means operatively associated with said supporting housing for directing working fluid into said working chamber via said support housing, said valve means comprising a member located co-axially with and rotatably relative to said supporting housing, said member having a passage or channel in communication with a supply of working fluid and a plurality of holes providing fluid communication between said passage or channel and said working chamber for a predetermined period of time per revolution of said supporting housing relative to said valve means.

11. The rotary machine according to claim 10, wherein the supporting housing is provided with a plurality of sockets extending longitudinally along its surface facing the working chamber and each gate is pivotally retained and supported in a respective socket to facilitate the swinging motion of the gates.

12. The rotary machine according to claim 11, wherein the sockets and the gates are complementarily shaped so that when the gates are in the retracted position their radially outermost surface lies substantially flush with, or below, the surface of the supporting housing facing the working chamber.

13. The rotary machine according to claim 12, wherein each socket and each gate is provided with a first set of respective stop surfaces that come into mutual abutment when the gates swing to the sealing position from the retracted position.

14. The rotary machine according to claim 13, wherein each socket and gate is provided with a second set of respective stop surfaces spaced from the first set of stop surfaces have come into mutual abutment when the gates swing to the sealing position from the retracted position.

15. The rotary machine according to claim 14, wherein said first and second sets of respective stop surfaces are positioned so as to come into respective mutual contact substantially simultaneously.

16. The rotary machine according to claim 15, wherein the supporting housing is provided with a plurality of inlet ports providing fluid communication between said passage or channel and the working chamber.

17. The rotary machine according to claim 16, wherein each inlet port has an opening into said working chamber and said gates are arranged to overlie said opening when in the retracted position wherein fluid passing through the inlet port urges said gate toward said sealing position.

18. The rotary machine according to claim 17, wherein said lobes form a seal against the surface of the supporting housing facing the working chamber to divide the working chamber into a plurality of sub-chambers, and wherein said lobes force said gates toward said retracted position upon engagement with said gates.

19. The rotary machine according to claim 10 wherein said member is a shaft which extends co-axially through said supporting housing and said passage extends axially into said shaft.

20. A rotary machine comprising:

an inner housing;

an outer housing in which the inner housing resides, one of the inner and outer housings being rotatable relative to another of the inner and outer housings, with a working chamber through which a working fluid flows being defined between the inner housing and the outer housing;

a plurality of gates supported by one of the inner housing and the outer housing, wherein the housing supporting the gates constitutes a supporting housing and the housing not supporting the gates constitutes a non-supporting housing, each gate swingable along its respective longitudinal axis between a sealing position in which the gates form a seal against a surface of the non-supporting housing and a retracted position in which the gates lie substantially against a surface of the supporting housing facing the working chamber; and a valve operatively associated with said supporting housing that directs said working fluid into the working chamber via the support housing, said valve providing fluid communication between a supply of said working fluid and said working chamber for a predetermined period of time per revolution of said supporting housing relative to said valve;

said supporting housing being provided with a plurality of inlet ports providing fluid communication between said valve and said working chamber, wherein each inlet port has an opening into said working chamber and said gates are arranged to overlie said opening when in the retracted position wherein fluid passing through said inlet port urges said gate toward said sealing position, a plurality of lobes supported by the non-supporting housing and which form a seal against a facing surface of the supporting housing thereby dividing the working chamber into a plurality of sub-chambers, each lobe defining an exhaust port for exhausting the working fluid from an adjacent sub-chamber wherein each of the exhaust ports comprising an axially extending bore formed through each of the lobes and a plurality of feed holes that passes through each of the lobes for communicating the working fluid between the working chamber and the bore, the valve comprising a shaft extending coaxially into and rotatable relative to the supporting housing, the shaft having an axial passage in fluid communication with a supply of said working fluid and a plurality of radially extending holes providing fluid communication between said axial passage and the inlet ports in the supporting housing for a predetermined period of time per revolution of the shaft relative to the supporting housing.

21. A rotary machine comprising:

a supporting housing;

a non-supporting housing in which the supporting housing resides, one of the supporting and the non-supporting housings being rotatable relative to another and concentric with each other, with a working chamber through which a working fluid flows being defined between the supporting housing and the non-supporting housing;

a plurality of gates supported by the supporting housing, each gate swingable along its respective longitudinal axis between a sealing position in which the gates form a seal against a surface of the non-supporting housing and a retracted position in which the gates are swung about their longitudinal axes to lie substantially against a surface of the supporting housing facing the working chamber, said supporting housing provided with a plurality of inlet ports through which the working fluid flows into the working chamber;

a plurality of lobes supported by the non-supporting housing and which form a seal against a facing surface of the supporting housing, thereby dividing the working chamber into a plurality of sub-chambers, each lobe defining an exhaust port for exhausting the working fluid from an adjacent sub-chamber wherein each of the exhaust ports comprising an axially extending bore formed through each of the lobes and a plurality of feed holes that passes through each of the lobes for communicating the working fluid between the working chamber and the bore; and a valve operatively associated with the supporting housing for directing working fluid into the sub-chambers via the support housing, the valve comprising a member located coaxially with and rotatable relative to the supporting housing, the member having a passage or channel in communication with a supply of working fluid and a plurality of holes providing fluid communication between the passage or channel and the inlet ports for a predetermined period of time per revolution of the supporting housing relative to the valve.

22. The machine according to claim 21, wherein the supporting housing is provided with a plurality of sockets extending longitudinally along its surface facing the working chamber and each gate is pivotally retained and supported in a respective socket to facilitate the swinging motion of the gates.

23. The machine according to claim 22, wherein the sockets and the gates are complementarily shaped so that when the gates are in the retracted position their radially outermost surface lies substantially flush with, or below, the surface of the supporting housing facing the working chamber.

24. The machine according to claim 23, wherein each socket and each gate is provided with a first set of respective stop surfaces that come into mutual abutment when the gates swing to the sealing position from the retracted position.

25. The machine according to claim 24, wherein each socket and each gate is provided with a second set of respective stop surfaces spaced from the first set of stop surfaces that come into mutual abutment when the gates swing to the sealing position from the retracted position.

26. The machine according to claim 25, wherein the first and the second sets of respective stop surfaces are positioned so as to come into respective mutual contact substantially simultaneously.

27. The machine according to claim 21, wherein each inlet port has an opening into said working chamber and said gates are arranged to overlie said opening when in the retracted position wherein fluid passing through the inlet port urges said gate toward said sealing position.

28. The machine according to claim 21, wherein the lobes are configured to force the gates toward the retracted position upon engagement of the lobes with the gates.

29. The machine according to claim 21, wherein the valve is provided with an adjuster to facilitate adjustment of the flow of the working fluid into the working chamber.

30. The machine according to claim 29, wherein said member comprises a shaft that extends coaxially through the supporting housing and the passage extends axially into the shaft.

31. The machine according to claim 30, wherein the adjuster comprises a sleeve located coaxially with the shaft and movable relative to the shaft, the sleeve provided with one or more apertures extending radially therethrough, and a device for effecting movement of the sleeve relative to the shaft to allow variation in overlap or alignment of the apertures and the holes to thereby control the flow of the working fluid from the supply to the working chamber.

32. The machine according to claim 31, wherein the device for effecting movement comprises a coupling acting between the non-supporting housing, a connector for connecting the rotary machine to a supporting apparatus and one of the shaft and the sleeve, whereby a torque differential between the non-supporting housing and the supporting apparatus is transmitted by the coupling to act between the sleeve and the shaft to effect the movement of the sleeve relative to the shaft.

33. The machine according to claim 21, wherein the member comprises a plate disposed coaxially of the non-supporting housing, the channel provided on a side of the plate distant from the supporting housing and the holes comprise slots cut in an axial direction through the plate for providing fluid communication between the channel and the working chamber for a predetermined period of time per revolution of the plate relative to the supporting housing.

* * * * *